US009709062B2

(12) United States Patent
Zheng et al.

(10) Patent No.: US 9,709,062 B2
(45) Date of Patent: Jul. 18, 2017

(54) CENTRIFUGAL COMPRESSOR AND MANUFACTURING METHOD THEREFOR

(75) Inventors: Xinqian Zheng, Beijing (CN); Yun Lin, Beijing (CN); Yangjun Zhang, Beijing (CN); Chuanjie Lan, Beijing (CN); Weilin Zhuge, Beijing (CN); Tomoki Kawakubo, Tokyo (JP); Hideaki Tamaki, Tokyo (JP)

(73) Assignee: IHI Corporation, Tokyo (JP)

( * ) Notice: Subject to any disclaimer, the term of this patent is extended or adjusted under 35 U.S.C. 154(b) by 690 days.

(21) Appl. No.: 14/006,914

(22) PCT Filed: Mar. 21, 2012

(86) PCT No.: PCT/JP2012/057136

§ 371 (c)(1),
(2), (4) Date: Nov. 29, 2013

(87) PCT Pub. No.: WO2012/128277

PCT Pub. Date: Sep. 27, 2012

(65) Prior Publication Data

US 2014/0255175 A1 Sep. 11, 2014

(30) Foreign Application Priority Data

Mar. 23, 2011 (CN) ..... 2011 1 0070488

(51) Int. Cl.
*F04D 17/10* (2006.01)
*F04D 29/44* (2006.01)

(52) U.S. Cl.
CPC ..... *F04D 17/10* (2013.01); *F04D 29/441* (2013.01); *F04D 29/444* (2013.01); *Y10T 29/49243* (2015.01)

(58) Field of Classification Search
CPC ..... F04D 29/541; F04D 29/522; F04D 25/14; F04D 25/0613; F04D 19/002
See application file for complete search history.

(56) References Cited

U.S. PATENT DOCUMENTS 3,289,921 A * 12/1966 Soo ..... F04D 29/441 415/207
4,181,466 A * 1/1980 Owen ..... F04D 25/04 29/888.024

(Continued)

FOREIGN PATENT DOCUMENTS

EP 1 411 223 A1 4/2004
JP 2-12097 1/1990

(Continued)

OTHER PUBLICATIONS

International Search Report issued in corresponding application No. PCT/JP2012/057136, completed May 30, 2012 and mailed Jun. 12, 2012.

(Continued)

*Primary Examiner* — Woody Lee, Jr.
(74) *Attorney, Agent, or Firm* — Griffin and Szipl PC

(57) ABSTRACT

A centrifugal compressor includes: a volute casing including a first casing and a second casing that are mutually coupled, the first casing including a volute chamber therein and the second casing including an impeller installation space therein; an impeller provided in the impeller installation space so as to be rotatable around a rotation axis; and a vaneless diffuser that has an inlet that communicates with an inside of the second casing and has an outlet that communicates with an inside of the first casing. The vaneless diffuser has a width having a non-axisymmetric distribution in the circumferential direction.

11 Claims, 4 Drawing Sheets

(56) References Cited

U.S. PATENT DOCUMENTS

| | | | | |
|---|---|---|---|---|
| 2002/0079158 | A1 | 6/2002 | Liu | |
| 2006/0275114 | A1* | 12/2006 | Mangnall | C02F 3/00 415/206 |
| 2009/0317248 | A1* | 12/2009 | Tanaka | F04D 29/441 415/224.5 |
| 2015/0132120 | A1* | 5/2015 | Yoeda | F01D 9/026 415/204 |

FOREIGN PATENT DOCUMENTS

| | | | | | |
|---|---|---|---|---|---|
| JP | 7-8597 | | | 2/1995 | |
| JP | 10-176699 | A | | 6/1998 | |
| JP | 10176699 | A | * | 6/1998 | F04D 29/46 |
| JP | 2000-213496 | A | | 8/2000 | |

OTHER PUBLICATIONS

CD-ROM of the specification and drawings annexed to the request of Japanese Utility Model Application No. 36956/1993 (Laid-open No. 8597/1995) (Mitsubishi Heavy Industries, Ltd. ), Feb. 7, 1995 (Feb. 7, 1995), paragraph [0019] (Family: none) (see Foreign Reference No. 2).

Microfilm of the specification and drawings annexed to the request of Japanese Utility Model Application No. 89940/1988 (Laid-open No. 12097/1990) (Mitsubishi Heavy Industries, Ltd.), Jan. 25, 1990 (Jan. 25, 1990), specification, p. 3, lines 3 to 8; p. 4, lines 3 to 8 (Family: none) (see Foreign Reference No. 3).

Extended European Search Report issued in co-pending related application No. 12760872.7, completed Oct. 29, 2014 and mailed Nov. 6, 2014.

* cited by examiner

CENTRIFUGAL COMPRESSOR AND MANUFACTURING METHOD THEREFOR

This is a National Phase Application in the United States of International Patent Application No. PCT/JP2012/057136 filed Mar. 21, 2012, which claims priority on Chinese Patent Application No. 201110070488.1 filed Mar. 23, 2011. The entire disclosures of the above patent applications are hereby incorporated by reference.

TECHNICAL FIELD

The present invention relates to a technical field of fluid machines including an impeller, and particularly relates to a centrifugal compressor including a vaneless diffuser.

BACKGROUND ART

Compressors including an impeller, such as a centrifugal compressor, have advantages such as having better efficiency, being smaller in dimensions and in weight and being more stable in operation than reciprocating compressors, but have a limited range of operating conditions relating to the flow rate. Under an operating condition at a low flow rate, a centrifugal compressor generates a phenomenon such as considerable fluid separation at the internal flow field, and causes a phenomenon of unstable operations. This causes stall and accordingly surge, thus rapidly decreasing the efficiency and the pressure-ratio of the compressor, shortening the life of the compressor and accordingly causing a damage of the compressor in a short time.

A vaneless diffuser of a centrifugal compressor has a flow channel, on both sides of which an annular cap and an annular disk are provided in a fixed manner, where their shapes are determined depending on the operating condition at the design point. This enables the most excellent performance at the design point, whereby the kinetic energy of fluid at the outlet of the impeller can be converted effectively into static-pressure energy. Conventional vaneless diffusers are structured axisymmetrically. That is, such a vaneless diffuser has a width that is uniformly distributed in the circumferential direction. During the operation at a low flow rate, the vaneless diffuser generates considerable fluid separation inside it, and such a stall phenomenon increases flow loss and so decreases the efficiency of the diffuser. As the flow rate further decreases, the kinetic energy of the fluid in the radial direction is not sufficient, and so the fluid flows backward due to the action of adverse pressure gradient and a surge phenomenon occurs at the compressor.

Herein the term vaneless in a vaneless diffuser refers to a diffuser as a flow channel that is not provided with vanes (blades).

Conventionally known methods of suppressing the stall in a vaneless diffuser provide a diffuser having a decreased width so as to increase the kinetic energy of the fluid in the radial direction for a low flow rate and to decrease the adverse current.

SUMMARY OF INVENTION

Technical Problem

However, since a centrifugal compressor has a non-axisymmetric volute casing, its vaneless diffuser also has internal flow parameters in the circumferential direction that are non-axisymmetric. That is, the internal flow field of the vaneless diffuser is non-axisymmetric. This means that the conventional method of using a diffuser having a decreased width, thus increasing the kinetic energy of the fluid in the radial direction and so decreasing the adverse current, has a limit and does not consider the non-axisymmetric properties at the internal flow field of the vaneless diffuser, and so fails in the maximum suppression of stall in the vaneless diffuser.

The present invention aims to at least solve one of the technical problems of the prior art.

To this end, it is an object of the present invention to provide a centrifugal compressor capable of reducing asymmetry of the flow field of the fluid inside a centrifugal compressor and expanding the stable operating range of the centrifugal compressor.

It is another object of the present invention to provide a method for manufacturing the centrifugal compressor.

Solution to Problem

In order to solve the above problems, a centrifugal compressor according to the present invention includes: a volute casing including a first casing and a second casing that are mutually coupled, the first casing including a volute chamber therein and the second casing including an impeller installation space therein; an impeller provided in the impeller installation space so as to be rotatable around a rotation axis; and a vaneless diffuser that has an inlet that communicates with an inside of the second casing and has an outlet that communicates with an inside of the first casing. The vaneless diffuser has a width having a non-axisymmetric distribution in a circumferential direction.

The centrifugal compressor of the present invention includes a vaneless diffuser having a width having a non-axisymmetric distribution in a circumferential direction, and thus the non-axisymmetry of the flow field of the fluid inside the centrifugal compressor can be reduced. This can then suppress stall of the vaneless diffuser of the centrifugal compressor, and so a stable operating range of the centrifugal compressor can be expanded.

According to a preferable embodiment of the present invention, the vaneless diffuser has a width at a circumferential position having an airflow angle $\alpha$ at an inlet of the vaneless diffuser that is smaller than a circumferential average value thereof, the width being smaller than a width at another circumferential position having an airflow angle $\alpha$ that is the circumferential average value or more, and the airflow angle $\alpha$ at the inlet of the vaneless diffuser is defined as an angle between projection velocity V obtained by projecting air velocity at the inlet of the vaneless diffuser on a plane perpendicular to the rotation axis and a circumferential direction at a corresponding circumferential position.

Preferably, the width of the vaneless diffuser is uniform in a radial direction at a same circumferential position.

According to a preferable embodiment of the present invention, the centrifugal compressor further may include an annular cap and an annular disk between the first casing and the second casing, and the vaneless diffuser may be a flow channel defined between the annular cap and the annular disk.

Preferably, the first casing, the second casing and the annular cap are integrally formed.

In a centrifugal compressor according to a preferable embodiment of the present invention, such a configuration of the vaneless diffuser having an asymmetric width in the circumferential direction acts so as to weaken the original non-axisymmetry of the airflow angle $\alpha$ at the inlet of the vaneless diffuser in the circumferential direction. This can effectively increase the minimum airflow angle $\alpha$ in the circumferential direction and so can suppress stall of the vaneless diffuser at a low flow rate, and further can expand the stable operating range of the centrifugal compressor.

According to a method for manufacturing the centrifugal compressor of the present invention, a prototype of a symmetric centrifugal compressor including a vaneless diffuser having a width that is uniform in the circumferential direction is modified so as to achieve the centrifugal compressor of the present invention.

That is, a method for manufacturing of the present invention is to manufacture the aforementioned centrifugal compressor, and includes the steps of:

(1) setting an initial position in the circumferential direction;

(2) acquiring distribution in the circumferential direction of an airflow angle $\alpha y$ at an inlet of the prototypical vaneless diffuser of the symmetric centrifugal compressor by numerical simulation or experiment, then calculating a circumferential average value $\alpha y_{avg}$ of the airflow angle $\alpha y$ at the inlet of the vaneless diffuser, and acquiring a width by of the vaneless diffuser;

(3) decreasing the width by of the vaneless diffuser at a circumferential position having an airflow angle $\alpha y$ at the inlet of the prototypical vaneless diffuser of the symmetric centrifugal compressor that is smaller than the circumferential average value $\alpha y_{avg}$, thus acquiring a first width b1 at the circumferential position, increasing the width by of the vaneless diffuser at a circumferential position having an airflow angle $\alpha y$ at the inlet of the prototypical vaneless diffuser of the symmetric centrifugal compressor that is larger than the circumferential average value $\alpha y_{avg}$, thus acquiring a first width b1 at the circumferential position, and, at the same time making a circumferential average value b1*y* of the first width b1 a same value of the width by of the prototypical vaneless diffuser of the symmetric centrifugal compressor or to be a value close to the width by, thereby acquiring distribution of the first width b1 of a first vaneless diffuser of a first centrifugal compressor in the circumferential direction;

(4) based on a result of the first width b1 at Step (3), acquiring distribution of the airflow angle $\alpha 1$ at the inlet of the first vaneless diffuser of the first centrifugal compressor in the circumferential direction by numerical simulation or experiment, and calculating a circumferential average value $\alpha 1_{avg}$ of the airflow angle $\alpha 1$ at the inlet of the first vaneless diffuser;

(5) based on the distribution of the airflow angle $\alpha 1$ at the inlet of the first vaneless diffuser in the circumferential direction at Step (4), decreasing the first width b1 of the first vaneless diffuser at a circumferential position having the airflow angle $\alpha 1$ at the inlet of the first vaneless diffuser that is smaller than the circumferential average value $\alpha 1_{avg}$, thus acquiring a second width b2 at the circumferential position, increasing the first width b1 of the first vaneless diffuser at a circumferential position having the airflow angle $\alpha 1$ at the inlet of the first vaneless diffuser that is larger than the circumferential average value $\alpha 1_{avg}$, thus acquiring a second width b2 at the circumferential position, and, at the same time making a circumferential average value b2*y* of the second width b2 a same value of the width by of the prototypical vaneless diffuser of the symmetric centrifugal compressor or to be a value close to the width by, thereby acquiring distribution of the second width b2 of a vaneless diffuser of a second centrifugal compressor in the circumferential direction;

(6) repeating step (4) and step (5) until the circumferential distribution of the width b of the diffuser can be obtained so that a minimum value $\alpha_{min}$ of the airflow angle $\alpha$ at the inlet of the vaneless diffuser in the circumferential direction becomes larger than a predetermined critical airflow angle; and (7) based on the distribution of the width b of the diffuser in the circumferential direction obtained at step (6), acquiring the centrifugal compressor.

In the above method, the airflow angle $\alpha$ at the inlet of the vaneless diffuser is defined as an angle between projection velocity V obtained by projecting air velocity at the inlet of the vaneless diffuser on a plane perpendicular to the rotation axis and a circumferential direction at a corresponding circumferential position.

Effects of Invention

The present invention includes a vaneless diffuser having a width having a non-axisymmetric distribution in a circumferential direction, and thus the non-axisymmetry of the flow field of the fluid inside the centrifugal compressor can be reduced. This can then suppress stall of the vaneless diffuser of the centrifugal compressor, and so a stable operating range of the centrifugal compressor can be expanded.

BRIEF DESCRIPTION OF DRAWINGS

The following describes embodiments of the present invention, with reference to the drawings, thus clarifying additional aspects and advantages of the present invention.

DESCRIPTION OF EMBODIMENTS

Figure 1:
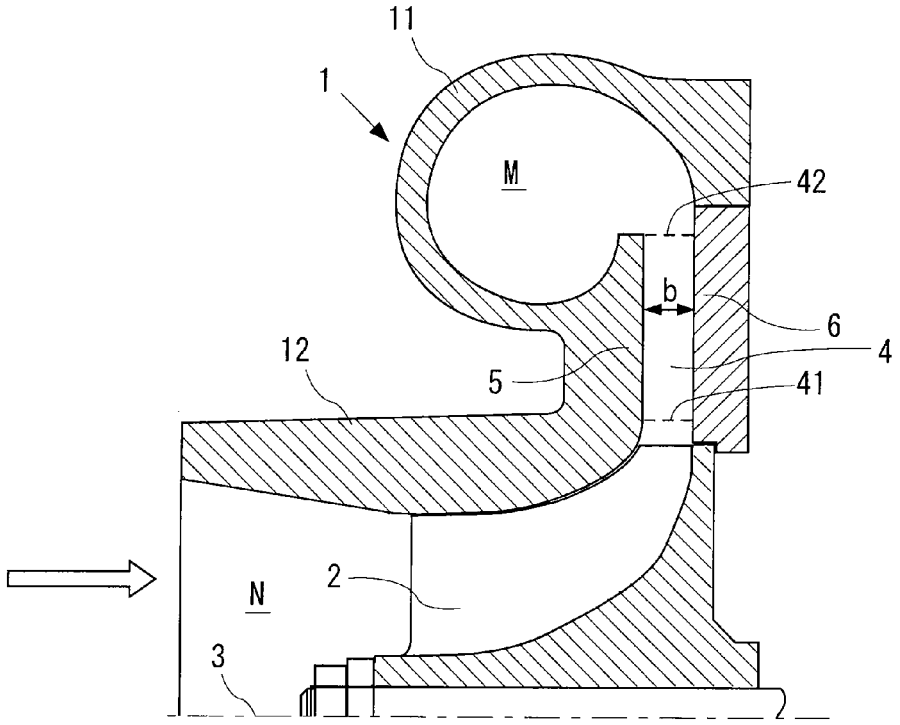
FIG. 1 is a cross-sectional view of a centrifugal compressor according to one embodiment of the present invention.

The following describes embodiments of the present invention in detail. The drawings illustrate the embodiments, where the same or similar elements or the same or similar functions are designated by the same or similar reference numerals. The following embodiments described with reference to the drawings are for illustration purposes and for merely explanation of the present invention, and are not to be regarded as restrictive.

In the following descriptions of the present invention, the terms such as "inside", "outside", "vertical", "horizontal", "above", "below", "top" and "bottom" represent directions or positional relationships based on the directions or positional relationships in the drawings, which are merely for explanatory convenience of the present invention and do not necessarily require the specific directional structure and operations of the present invention, and thus these terms are not to be regarded as restrictive in the present invention.

Figure 2:
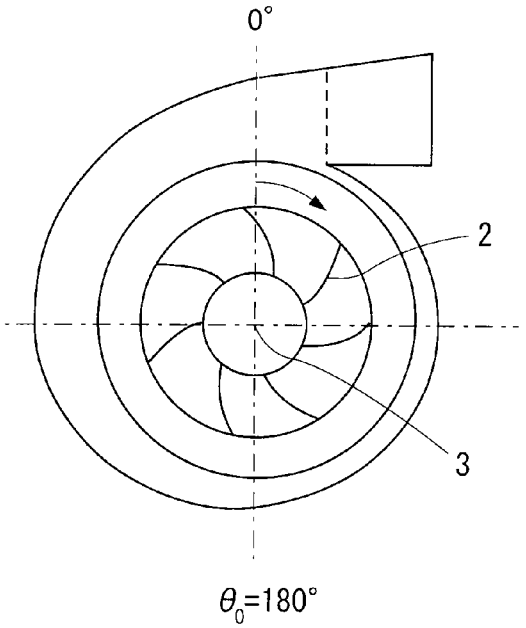
FIG. 2 schematically shows a centrifugal compressor viewed from its axial direction, which is to define the circumferential direction of the centrifugal compressor according to one embodiment of the present invention.
Figure 3:
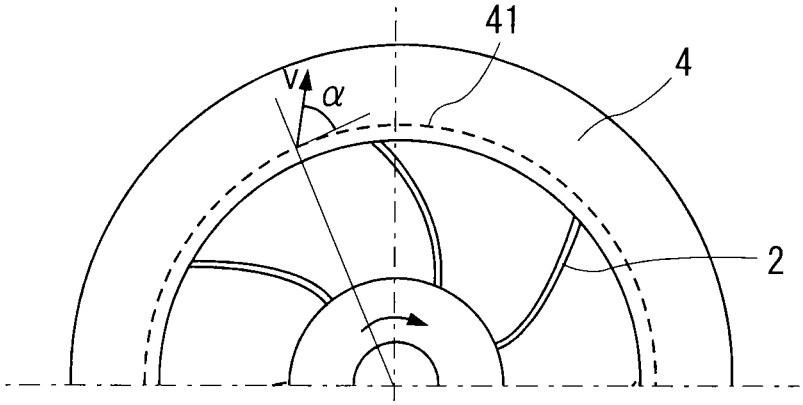
FIG. 3 is a partial schematic view of a centrifugal compressor viewed from its axial direction, which is to define an airflow angle $\alpha$ at the inlet of the vaneless diffuser.

Referring now to FIGS. 1 to 3, the following describes a centrifugal compressor according to one embodiment of the present invention. In the following description, the rotating direction around a rotation axis 3 is called a circumferential direction (indicated by the arrow in FIG. 2), the direction parallel to the rotation axis 3 is called a axial direction, the radial direction of the rotation axis 3 is called a radial direction, and a position in the circumferential direction is called a circumferential position. In the description of the present invention, a parameter having "distribution that is asymmetric or non-axisymmetric" refers to the distribution of the parameter at the circumferential position being non-axisymmetric, meaning that the parameter is not uniform in the circumferential direction.

As shown in FIG. 1, the centrifugal compressor according to one embodiment of the present invention includes: a volute casing 1; an impeller 2; and a vaneless diffuser 4. The volute casing 1 includes a first casing 11 and a second casing 12 that are mutually coupled. The first casing 11 includes a volute chamber (scroll flow channel) M provided therein, and the second casing 12 includes an impeller installation space N provided therein. The impeller 2 is provided in the impeller installation space N so as to be rotatable around the rotation axis 3. The vaneless diffuser 4 has an inlet 41 (lower dashed line of FIG. 1) that communicates with the inside of the second casing 12, and has an outlet 42 (upper dashed line of FIG. 1) that communicates with the inside of the first casing 11. Herein, the vaneless diffuser 4 has a width having a non-axisymmetric distribution in the circumferential direction so as to be suitable for the non-axisymmetry of the fluid flow inside the centrifugal compressor.

During an operation, the impeller 2 rotates about the rotation axis 3, thus sucking fluid into the centrifugal compressor along the direction of the arrow of FIG. 1 and thus increasing the kinetic energy and the pressure of the fluid. As the fluid moves away from the impeller 2 and enters the vaneless diffuser 4, the kinetic energy of the fluid is then converted into pressure energy, whereby the pressure of the fluid rises, and finally the fluid flows out of the vaneless diffuser 4 and enters the volute chamber M.

The centrifugal compressor according to one embodiment of the present invention is designed so that the width of the vaneless diffuser 4 has a non-axisymmetric distribution in the circumferential direction, whereby non-axisymmetry in the flow field of the fluid inside the centrifugal compressor can be reduced. This can then suppress stall of the vaneless diffuser 4 of the centrifugal compressor, and so the stable operating range of the centrifugal compressor can be expanded.

As shown in FIG. 2, assuming the initial position in the circumferential direction (0°), the circumferential angle described in the present invention is an angle deviating from the initial position along the circumferential direction. The description of the present invention exemplifies the case of deviation along the clockwise direction. That is, the circumferential angle indicates the phase around the rotation axis 3 (circumferential position) and has a value of 0° to 360°.

In one embodiment of the present invention, the vaneless diffuser 4 has a width b at a circumferential position having an airflow angle $\alpha$ at the inlet of the vaneless diffuser that is smaller than a circumferential average value thereof, and the width b is smaller than a width at another circumferential position having an airflow angle $\alpha$ that is the circumferential average value (i.e., the average value of the airflow angle $\alpha$ in the circumferential direction) or more. Herein, as shown in FIG. 3, the airflow angle $\alpha$ at the inlet of the vaneless diffuser is defined as an angle between the projection velocity V obtained by projecting the air velocity at the inlet 41 of the vaneless diffuser 4 on a plane perpendicular to the rotation axis 3 and a tangent line at the circumferential position (circumferential direction). The width b of the vaneless diffuser 4 is uniform in the radial direction at the same circumferential position.

This embodiment designs the vaneless diffuser based on the principle that the airflow angle $\alpha$ at the inlet of the vaneless diffuser at a circumferential position and the width b of the vaneless diffuser at the corresponding position have the relationship of $\tan \alpha = c/b$, where c is one constant corresponding to the circumferential direction.

The centrifugal compressor according to one embodiment of the present invention is provided with an annular cap 5 and an annular disk 6 between the first casing 11 and the second casing 12 in the radial direction. The vaneless diffuser 4 is defined as a flow channel provided between the annular cap 5 and the annular disk 6. The first casing 11, the second casing 12 and the annular cap 5 are integrally formed, and the annular disk 6 is detachably mounted on the first casing 11 and the second casing 12.

Figure 4:
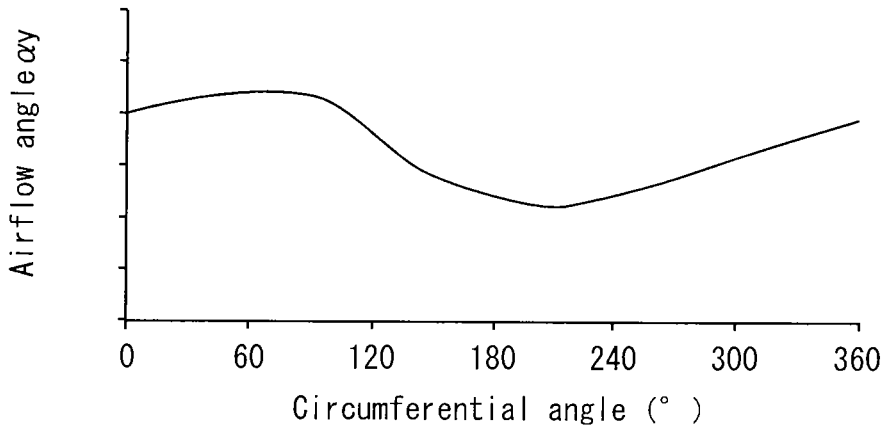
FIG. 4 shows circumferential distribution of the airflow angle $\alpha y$ at the inlet of a prototypical vaneless diffuser of a symmetric centrifugal compressor that is the basis of a centrifugal compressor according to one embodiment of the present invention.

Specifically, as shown in FIG. 4, the conventional centrifugal compressor includes a non-axisymmetric volute casing and so generates non-axisymmetry at the flow field of the fluid inside the vaneless diffuser under an operating condition at a low flow rate. Thus the airflow angle $\alpha$ at the inlet of the vaneless diffuser has a non-axisymmetric distribution in the circumferential direction. In general, if the airflow angle $\alpha$ at the inlet of the vaneless diffuser is smaller than a predetermined critical airflow angle, the vaneless diffuser may generate stall, and if the flow rate further decreases, then the kinetic energy of the fluid in the radial direction is not sufficient, and so the fluid flows backward due to the action of adverse pressure gradient and a surge phenomenon occurs at the centrifugal compressor.

To solve the aforementioned problem, the centrifugal compressor according to one embodiment of the present invention includes a vaneless diffuser having a width b that is distributed asymmetrically in the circumferential direction and that is not changed in the radial direction at the same circumferential position. Specifically, the vaneless diffuser should be designed to have a smaller width b at a circumferential position having a small airflow angle $\alpha$ at the inlet of the vaneless diffuser. The relationship between the airflow angle $\alpha$ at the inlet of the vaneless diffuser at the circumferential position and the width b of the vaneless diffuser at the corresponding position, i.e., $\tan \alpha = c/b$, decreases the value of the width b of the vaneless diffuser at a circumferential position originally having small airflow angle $\alpha$ and so increases the airflow angle $\alpha$.

Such a configuration of the vaneless diffuser having an asymmetric width in the circumferential direction acts so as to weaken the original non-axisymmetry of the airflow angle $\alpha$ at the inlet of the vaneless diffuser in the circumferential direction. This can effectively increase the minimum airflow angle $\alpha$ in the circumferential direction and so can suppress stall of the vaneless diffuser at a low flow rate, and further can expand the stable operating range of the centrifugal compressor.

Referring next to FIGS. 2 to 6, the following describes a method for manufacturing a centrifugal compressor according to one embodiment of the present invention. This centrifugal compressor can be designed by modifying a symmetric centrifugal compressor as a prototype, which includes a prototypical vaneless diffuser having a width that is symmetric (constant) in the circumferential direction.

The method for manufacturing a centrifugal compressor according to one embodiment of the present invention includes the following steps.

(1) As shown in FIG. 2, the initial position (the position of 0°) in the circumferential direction is set.

(2) As shown in FIG. 4, the circumferential distribution of the airflow angle $\alpha y$ at the inlet of the prototypical vaneless diffuser of the symmetric centrifugal compressor is acquired by numerical simulation or experiment, and then the circumferential average value $\alpha y_{avg}$ of the airflow angle $\alpha y$ at the inlet of the vaneless diffuser is calculated. At the same time, the width by of the prototypical vaneless diffuser of the symmetric centrifugal compressor is acquired. Performance of the symmetric centrifugal compressor as the prototype is acquired by a performance test of the centrifugal compressor.

Herein, the airflow angle $\alpha y$ at the inlet of the vaneless diffuser is defined as an angle between the projection velocity V (i.e., velocity that is obtained by vertical-projecting the three-dimensional air velocity on a plane perpendicular to the rotation axis) obtained by projecting the air velocity (i.e., three-dimensional air velocity represented with three-dimensional vector) at the inlet of the vaneless diffuser on the plane perpendicular to the rotation axis and the direction of a tangent line (i.e., circumferential direction) at the corresponding circumferential position (the same applies to the airflow angles $\alpha$, $\alpha 1$).

(3) Based on the design principle described in the above embodiment, i.e., based on tan $\alpha$=c/b, the width by of the vaneless diffuser is appropriately decreased at each circumferential position having the airflow angle $\alpha y$ at the inlet of the prototypical vaneless diffuser of the symmetric centrifugal compressor that is smaller than the circumferential average value $\alpha y_{avg}$, thus acquiring a first width b1 at the circumferential position.

Similarly, based on tan $\alpha$=c/b, the width by of the vaneless diffuser is appropriately increased at each circumferential position having the airflow angle $\alpha y$ at the inlet of the prototypical vaneless diffuser of the symmetric centrifugal compressor that is larger than the circumferential average value $\alpha y_{avg}$, thus acquiring a first width b1 at the circumferential position.

For such setting of the first width b1, the circumferential average value b1$y$ of the first width b1 is set so as to be the same value of the width by of the prototypical vaneless diffuser of the symmetric centrifugal compressor or to be a value close to the width by.

As a result, the distribution of the first width b1 in the circumferential direction of the vaneless diffuser of the first centrifugal compressor (hereinafter called a first vaneless diffuser) can be obtained. Then, the circumferential average value b1$y$ of the first width b1 and the width by of the prototypical vaneless diffuser of the symmetric centrifugal compressor are set to be substantially the same, whereby stable performance of the first centrifugal compressor is assured.

(4) Based on the result of the first width b1 (i.e., the circumferential distribution of the first width b1) at Step (3), the distribution of the airflow angle $\alpha 1$ at the inlet of the first vaneless diffuser of the first centrifugal compressor in the circumferential direction is obtained by numerical simulation or experiment, the circumferential average value $\alpha 1_{avg}$ of the airflow angle $\alpha 1$ at the inlet of the first vaneless diffuser is calculated, and the performance of the first centrifugal compressor is obtained by a performance test of the centrifugal compressor. Then, the obtained performance of the first centrifugal compressor is compared with the performance of the symmetric centrifugal compressor as the prototype acquired at Step (2).

(5) Based on the distribution of the airflow angle $\alpha 1$ at the inlet of the first vaneless diffuser in the circumferential direction at Step (4), the first width b1 of the first vaneless diffuser is appropriately decreased at each circumferential position having the airflow angle $\alpha 1$ at the inlet of the first vaneless diffuser that is smaller than the circumferential average value $\alpha 1_{avg}$, thus acquiring a second width b2 at the circumferential position.

Similarly, the width b1 of the first vaneless diffuser is appropriately increased at each circumferential position having the airflow angle $\alpha 1$ at the inlet of the first vaneless diffuser that is larger than the circumferential average value $\alpha 1_{avg}$, thus acquiring a second width b2 at the circumferential position.

For such setting of the second width b2, the circumferential average value b2$y$ of the second width b2 is set so as to be the same value of the width by of the vaneless diffuser of the symmetric centrifugal compressor as the prototype or to be a value close to the width by.

In this way, the distribution of the second width b2 in the circumferential direction of the vaneless diffuser of the second centrifugal compressor can be obtained. Then, the circumferential average value b2$y$ of the second width b2 and the width by of the prototypical vaneless diffuser of the symmetric centrifugal compressor are set to be substantially the same, whereby stable performance of the second centrifugal compressor is assured.

(6) Step (4) and Step (5) are repeated until the circumferential distribution of the width b of the diffuser can be obtained so that a minimum value $\alpha_{min}$ of the airflow angle $\alpha 1$ at the inlet of the first vaneless diffuser in the circumferential direction becomes larger than a predetermined critical airflow angle, thus repeating correction of the width of the vaneless diffuser, while acquiring performance of a corresponding centrifugal compressor newly corrected by the performance test of the centrifugal compressor. Then, the obtained performance is compared with the performance of the symmetric centrifugal compressor as the prototype acquired at Step (2), thus checking whether each correction brings an advantageous effect for the performance of the centrifugal compressor.

Herein, during the repeating of Step (4) and Step (5), Step (4) is repeated, based on the distribution of the second width b2 in the circumferential direction that is obtained at the immediately preceding Step (5), rather than based on the distribution of the first width b1 in the circumferential direction.

Herein, the predetermined critical airflow angle is specifically determined depending on the type of the centrifugal compressor.

Figure 5:
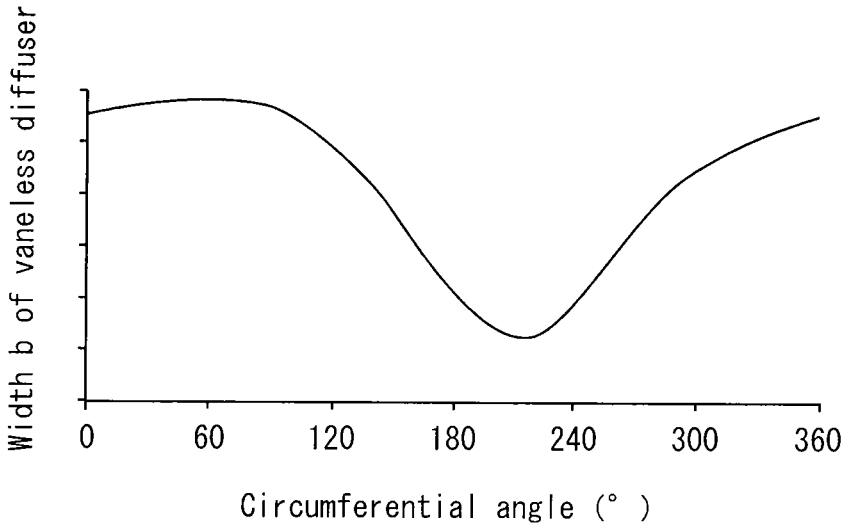
FIG. 5 shows circumferential distribution of the width b of a vaneless diffuser of a centrifugal compressor according to one embodiment of the present invention.

(7) Based on the distribution of the width b of the vaneless diffuser 4 in the circumferential direction shown in FIG. 5, which is obtained at Step (6), an optimized centrifugal compressor is finally obtained. Such a centrifugal compressor has optimized performance.

The aforementioned centrifugal compressor and method for manufacturing the same according to one embodiment are based on one type of a symmetric centrifugal compressor as the prototype, and the present invention is not limited to this. Those who skilled in the art can understand that based on different types of symmetric centrifugal compressors as the prototype, corresponding centrifugal compressors of different types including a vaneless diffuser having a non-axisymmetric width b can be obtained. Any centrifugal compressor and a method for manufacturing the same that are obtained by modifying a symmetric centrifugal compressor as the prototype by the same or a similar method as the above principle are included in the scope of the protection of the present invention.

Figure 6:
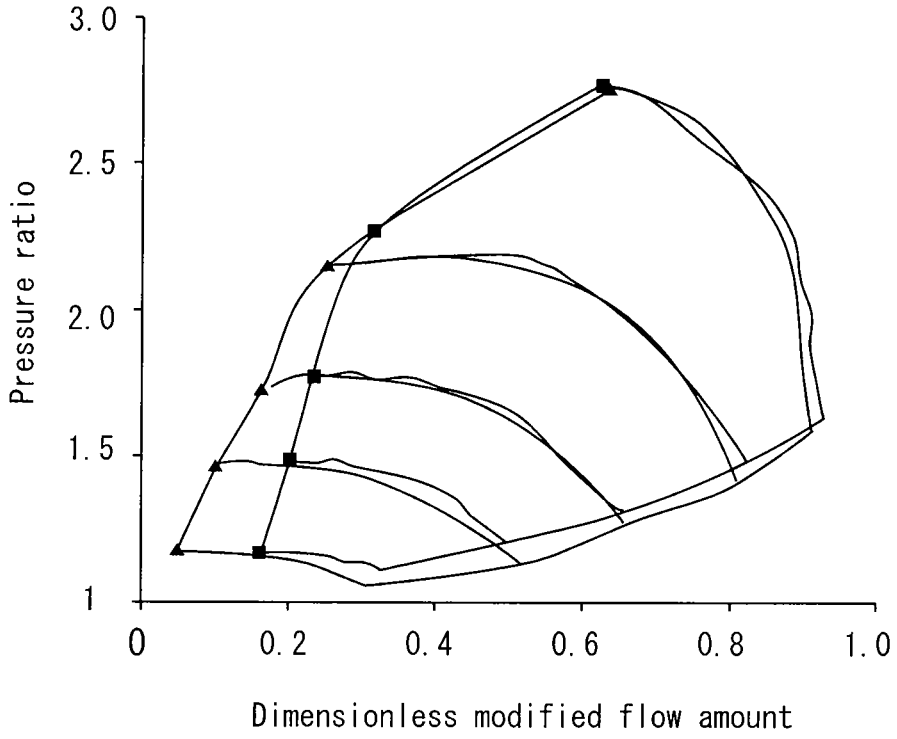
FIG. 6 shows a comparison of performance between a centrifugal compressor according to one embodiment of the present invention and a conventional symmetric centrifugal compressor corresponding thereto.

FIG. 6 shows a comparison of performance between a centrifugal compressor according to one embodiment of the present invention that is obtained by a performance test of the centrifugal compressor and a conventional symmetric centrifugal compressor as the prototype corresponding thereto. Herein, the centrifugal compressor according to one embodiment of the present invention includes a non-axisymmetric vaneless diffuser, and the symmetric centrifugal compressor as the prototype includes a conventional symmetric vaneless diffuser. In FIG. 6, data indicated with triangle marks shows the performance characteristics of the centrifugal compressor according to one embodiment of the present invention, and data indicated with square marks shows the performance characteristics of the centrifugal compressor including a conventional symmetric vaneless diffuser. In FIG. 6, the horizontal axis represents an intake flow amount of the centrifugal compressor, which is a modified flow amount that is made dimensionless with a reference flow amount, and the vertical axis represents the pressure ratio. As can be seen from FIG. 6, the centrifugal compressor according to one embodiment of the present invention has a wider and stable operating range, and so can achieve a retarding effect with a less flow amount.

Other configurations and operations of the centrifugal compressor according to one embodiment of the present invention are all known for those skilled in the art, and so their detailed descriptions are omitted. In the description of the present specification, "one embodiment", "partial embodiment", "conceptual embodiment", "illustration", "specific illustration" or "partial illustration" and the like as referential expressions represent specific features, structures, materials or characteristics described in the embodiment or the illustration, meaning that they are at least included in one embodiment or illustration of the present invention. In the present specification, these expressions do not always represent the same embodiment or illustration. The specific features, structures, materials or characteristics described may be combined in an appropriate form in any one or a plurality of embodiments or illustrations.

That is the description of the present invention, and those skilled in the art may change, alter, replace and modify the above-stated embodiments variously in the range without departing from the principle and the technical idea of the present invention. The scope of the present invention is defined by the appended claims and any and all equivalents thereof.

REFERENCE SIGNS LIST

1: volute casing, 2: impeller, 3: rotation axis, 4: vaneless diffuser, 5: annular cap, 6: annular disk, 11: first casing, 12: second casing, 41: inlet of vaneless diffuser, 42: outlet of vaneless diffuser

The invention claimed is:

1. A centrifugal compressor, comprising:

a volute casing including a first casing and a second casing, the first casing including a volute chamber therein and the second casing including an impeller installation space therein;

an impeller provided in the impeller installation space so as to be rotatable around a rotation axis; and a vaneless diffuser that includes an inlet that communicates with an inside of the second casing and includes an outlet that communicates with an inside of the first casing, wherein the vaneless diffuser has a width that changes over an entire range in a circumferential direction rotating around the rotation axis such that, as a position of the vaneless diffuser is shifted in the circumferential direction, the width gradually increases, and then, gradually decreases.

2. The centrifugal compressor according to claim 1, wherein the vaneless diffuser has a width at a position in the circumferential direction wherein an airflow angle $\alpha$ at an inlet of the vaneless diffuser is smaller than an average value thereof in the circumferential direction, the width being smaller than a width at another position in the circumferential direction wherein an airflow angle $\alpha$ is the average value or more, and each of the airflow angles $\alpha$ at the inlet of the vaneless diffuser is defined as an angle between the circumferential direction and projection velocity V obtained by projecting air velocity at the inlet of the vaneless diffuser on a plane perpendicular to the rotation axis at the corresponding position in the circumferential direction.

3. The centrifugal compressor according to claim 2, wherein the width of the vaneless diffuser is uniform in a radial direction of the rotation axis at a same position in the circumferential direction.

4. The centrifugal compressor according to claim 1, further comprising an annular cap and an annular disk between the first casing and the second casing, and the vaneless diffuser is a flow channel defined between the annular cap and the annular disk.

5. The centrifugal compressor according to claim 4, wherein the first casing, the second casing and the annular cap are integrally formed.

6. The centrifugal compressor according to claim 1, wherein the width of the vaneless diffuser changes over the entire range in the circumferential direction rotating around the rotation axis such that non-axisymmetry, with respect to the rotation axis, of a flow field of fluid inside the centrifugal compressor is reduced.

7. A method for manufacturing a centrifugal compressor including an objective vaneless diffuser having a width that is nonuniform in a circumferential direction rotating around a rotation axis thereof, the centrifugal compressor being a modification of a symmetric centrifugal compressor as a prototype including a prototypical vaneless diffuser having a width that is uniform in a circumferential direction rotating around a rotation axis thereof, the method comprising the steps of:

(1) setting an initial position in the circumferential direction;

(2) acquiring distribution in the circumferential direction of an airflow angle $\alpha y$ at an inlet of the prototypical vaneless diffuser of the symmetric centrifugal compressor by numerical simulation or experiment, then calculating an average value $\alpha y_{avg}$ in the circumferential direction of the airflow angle $\alpha y$ at the inlet of the prototypical vaneless diffuser, and acquiring a width by of the prototypical vaneless diffuser;

(3) decreasing the width by of the prototypical vaneless diffuser at a position in a circumferential direction wherein an airflow angle $\alpha y$ at the inlet of the prototypical vaneless diffuser of the symmetric centrifugal compressor is smaller than the average value $\alpha y_{avg}$, thus acquiring a first width b1 at the position in the circumferential direction, increasing the width by of the prototypical vaneless diffuser at a position in the circumferential direction wherein an airflow angle $\alpha y$ at the inlet of the prototypical vaneless diffuser of the symmetric centrifugal compressor is larger than the average value $\alpha y_{avg}$, thus acquiring a first width b1 at the position in the circumferential direction, and, at the same time making an average value b1*y* in the circumferential direction of the first width b1 a same value of the width by of the prototypical vaneless diffuser of the symmetric centrifugal compressor or a value substantially the same as the width by, thereby acquiring distribution in the circumferential direction of the first width b1 of a first vaneless diffuser of a first centrifugal compressor;

(4) based on a result of the first width b1 at step (3), acquiring distribution in the circumferential direction of an airflow angle $\alpha 1$ at the inlet of the first vaneless diffuser of the first centrifugal compressor by numerical simulation or experiment, and calculating an average value $\alpha 1_{avg}$ in the circumferential direction of the airflow angle $\alpha 1$ at the inlet of the first vaneless diffuser;

(5) based on the distribution in the circumferential direction of the airflow angle $\alpha 1$ at the inlet of the first vaneless diffuser in the circumferential direction at step (4), decreasing the first width b1 of the first vaneless diffuser at a position in the circumferential direction wherein the airflow angle $\alpha 1$ at the inlet of the first vaneless diffuser is smaller than the average value $\alpha 1_{avg}$, thus acquiring a second width b2 at the position in the circumferential direction, increasing the first width b1 of the first vaneless diffuser at a position in the circumferential direction wherein the airflow angle $\alpha 1$ at the inlet of the first vaneless diffuser is larger than the average value $\alpha 1_{avg}$, thus acquiring a second width b2 at the position in the circumferential direction, and, at the same time making an average value b2*y* in the circumferential direction of the second width b2 a same value of the width by of the prototypical vaneless diffuser of the symmetric centrifugal compressor or a value substantially the same as the width by, thereby acquiring distribution in the circumferential direction of the second width b2 of a second vaneless diffuser of a second centrifugal compressor;

(6) repeating step (4) and step (5) until the distribution in the circumferential direction of the width b of an updated vaneless diffuser acquired by repeating step (4) and step (5) can be obtained so that a minimum value $\alpha_{min}$ of the airflow angle a at the inlet of the updated vaneless diffuser in the circumferential direction becomes larger than a predetermined critical airflow angle; and (7) based on the distribution of the width b of the diffuser in the circumferential direction obtained at step (6), manufacturing the centrifugal compressor including a volute casing including a first casing and a second casing, the first casing including a volute chamber therein and the second casing including an impeller installation space therein, an impeller provided in the impeller installation space so as to be rotatable around a rotation axis, and the objective vaneless diffuser with a width distribution according to step (6) and that includes an inlet that communicates with an inside of the second casing and includes an outlet that communicates with an inside of the first casing.

8. The method for manufacturing according to claim 7, wherein the airflow angle $\alpha$ at the inlet of the vaneless diffuser is an angle between the circumferential direction and projection velocity V obtained by projecting air velocity at the inlet of the vaneless diffuser on a plane perpendicular to the rotation axis at a corresponding position in the circumferential direction.

9. The method according to claim 7, wherein the first casing and the second casing are integrally formed.

10. A method for manufacturing a centrifugal compressor including an objective vaneless diffuser having a width that is nonuniform in a circumferential direction rotating around a rotation axis thereof, the method comprising the steps of:

(1) for a symmetric centrifugal compressor, including a prototypical vaneless diffuser, wherein a width of the prototypical vaneless diffuser is uniform in the circumferential direction rotating around a rotation axis thereof, acquiring distribution in the circumferential direction of an airflow angle at an inlet of the prototypical vaneless diffuser by numerical simulation or experiment and acquiring an average value in the circumferential direction of the airflow angle at the inlet of the prototypical vaneless diffuser;

(2) decreasing the width of the prototypical vaneless diffuser in the symmetric centrifugal compressor at a position in the circumferential direction where the airflow angle at the inlet of the prototypical vaneless diffuser is smaller than the average value; and (3) manufacturing the centrifugal compressor that comprises a volute casing including a first casing and a second casing, the first casing including a volute chamber therein and the second casing including an impeller installation space therein, an impeller provided in the impeller installation space so as to be rotatable around a rotation axis; and the objective vaneless diffuser that includes an inlet that communicates with an inside of the second casing and includes an outlet that communicates with an inside of the first casing, wherein the objective vaneless diffuser has the decreased width at the position in the circumferential direction where the width of the prototypical vaneless diffuser is decreased at step (2).

11. The method according to claim 10, wherein the first casing and the second casing are integrally formed.

* * * * *